United States Patent [19]

Michel

[11] Patent Number: 4,484,864

[45] Date of Patent: Nov. 27, 1984

[54] PERISTALTIC PUMP

[75] Inventor: Raymond Michel, Juvisy sur Orge, France

[73] Assignee: Delasco, Paris, France

[21] Appl. No.: 452,334

[22] Filed: Dec. 22, 1982

[30] Foreign Application Priority Data

Dec. 31, 1981 [FR] France ..... 81 24613

[51] Int. Cl.[3] ..... F04B 43/12; F04B 45/08

[52] U.S. Cl. ..... 417/477

[58] Field of Search ..... 417/475, 476, 477

[56] References Cited

U.S. PATENT DOCUMENTS

| | | | |
|---|---|---|---|
| 459,055 | 9/1891 | Truax | 417/477 |
| 3,431,864 | 3/1969 | Jones | 417/475 |
| 3,700,361 | 10/1972 | De Vries | 417/477 |
| 3,762,836 | 10/1973 | De Vries | 417/477 X |
| 4,095,923 | 6/1978 | Cullis | 417/477 X |

FOREIGN PATENT DOCUMENTS

| | | | |
|---|---|---|---|
| 1402241 | 5/1965 | France . | |
| 2288238 | 5/1976 | France . | |
| 681 | of 1902 | United Kingdom | 417/477 |
| 245057 | 1/1926 | United Kingdom . | |
| 628785 | 9/1949 | United Kingdom | 417/477 |
| 1167570 | 10/1969 | United Kingdom . | |
| 1498376 | 1/1978 | United Kingdom . | |
| 1506697 | 4/1978 | United Kingdom . | |

*Primary Examiner*—Richard E. Gluck

*Attorney, Agent, or Firm*—Dennison, Meserole, Pollack & Scheiner

[57] ABSTRACT

The invention relates to the means provided in a peristaltic pump to regulate the radial distance between a crushing roller and the axle of rotation of the rotor.

The rotor comprises at least one reference face parallel to its axle of rotation, the regulating element being a support of the axle of rotation of the roller provided with a surface which is held in contact with the face of the rotor, whereas a plurality of orifices are provided in the rotor and one orifice is provided in the support and is designed to be placed over one of the orifices of said plurality by moving the support along the said face and surface and to receive a connecting member traversing them.

The invention finds an application in peristaltic pumps.

2 Claims, 4 Drawing Figures

II
II
1
1a
2
3
4
5
6
7
8
9
10
11
12
14
D

I
I
2
3
4
5
6
7
8a
8b
8c
9
10
14

Fig. 3
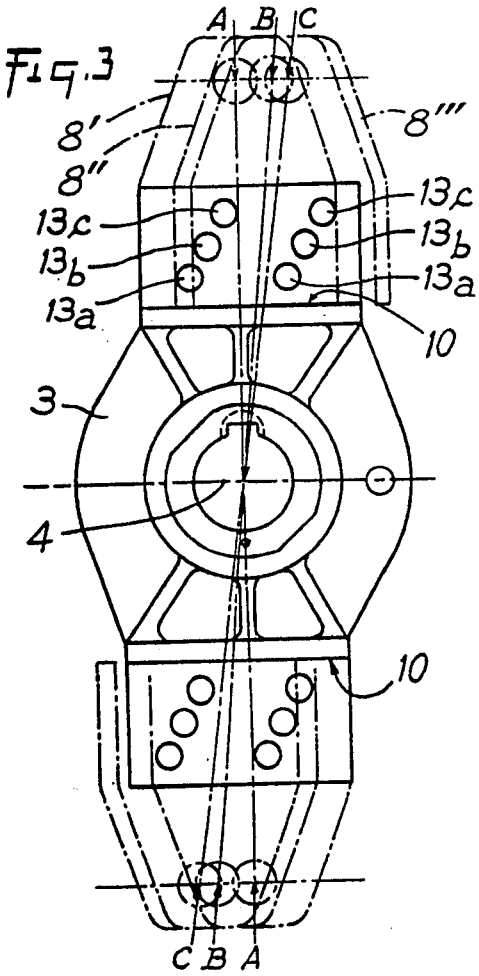
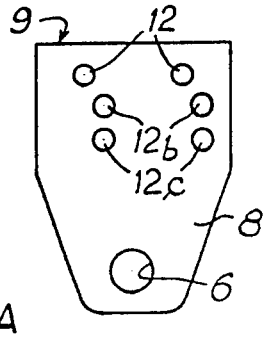
Fig. 3A

PERISTALTIC PUMP

The working principle of a peristaltic pump resides in the crushing of an elastically deformable tube in at least one point, so as to divide its inner volume into two chambers sealed one with respect to the other, and in the displacement of this crushing point along the tube so as to push the product contained inside the tube upstream of said crushing point, and also in drawing-in said product behind the said crushing point due to the suction effect caused by the tube tending to elastically recover its initial shape. A high pressure chamber and a low pressure chamber are thus created inside the pump, which chambers are separated by a movable tight zone, on the quality of which depends the operation of the pump.

The quality of the tightness is dependent on the crushing of the tube which is itself dependent on the nature of the material used and on its degree of wear. Consequently, it is necessary to be able to regulate to a certain extent the tube crushing value to allow for these particular parameters.

The object of the invention is to propose a peristaltic pump which comprises means permitting to regulate easily the crushing and overcrushing of the tube to, either adjust this value in relation to the required suction and delivery pressures, or to compensate for the wearing down of the tube which can badly affect the efficiency and performance of the pump, or to select the maximum crushing value permitting to obtain the most wear from the tube depending on the work or works to be carried out. This control also enables to adapt the crushing value so as to obtain a regular flow for pumps working at low speeds thus permitting to carry out proportioning operations with such pumps.

Such a pump comprises a stator, an elastically deformable tube placed along a surface supporting the stator, and a rotor provided with a plurality of members designed to crush the tube against the said supporting surface, and evenly distributed around the rotor, each of said crushing members being coupled to the rotor by way of an element for regulating the radial distance separating it from the axis of rotation of said rotor.

Said rotor comprises at least one reference face parallel to the axis of rotation of the rotor and said regulating element is constituted by a support of the axle of rotation of the roller provided with a reference surface held in contact with the said reference face of the rotor, whereas at least a plurality of orifices are provided in the rotor and at least one orifice is provided in the said support and is designed to be placed over one of the orifices from the said plurality of orifices, by moving the support with respect to the rotor along the said reference face and surface, inside a radial plane of the rotor, and to receive a traversing connecting member.

Moreover, in the case where the pump comprises two diametrically opposite crushing rollers, the rotor comprises two reference faces parallel together, each one cooperating with a corresponding support.

The invention will be more readily understood on reading the following description with reference to the accompanying drawings, in which:

FIG. 3 is an external view of only the rotor of the pump according to FIGS. 1 and 2.

FIG. 3A illustrates one embodiment of a regulating element according to the invention.

Figure 1:
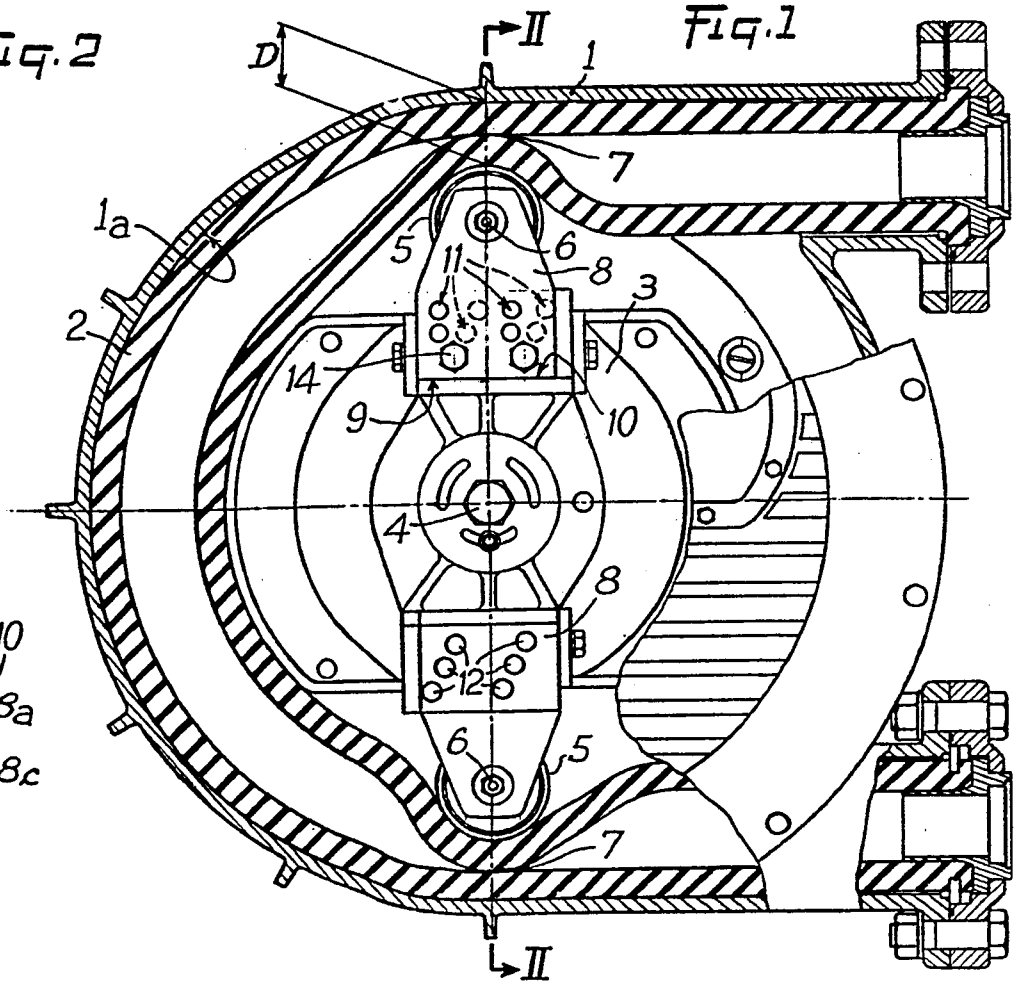
FIGS. 1 and 2 are cross-sectional views of a pump according to the invention, taken along line I—I of FIG. 2 and along line II—II of FIG. 1, respectively.
Figure 2:
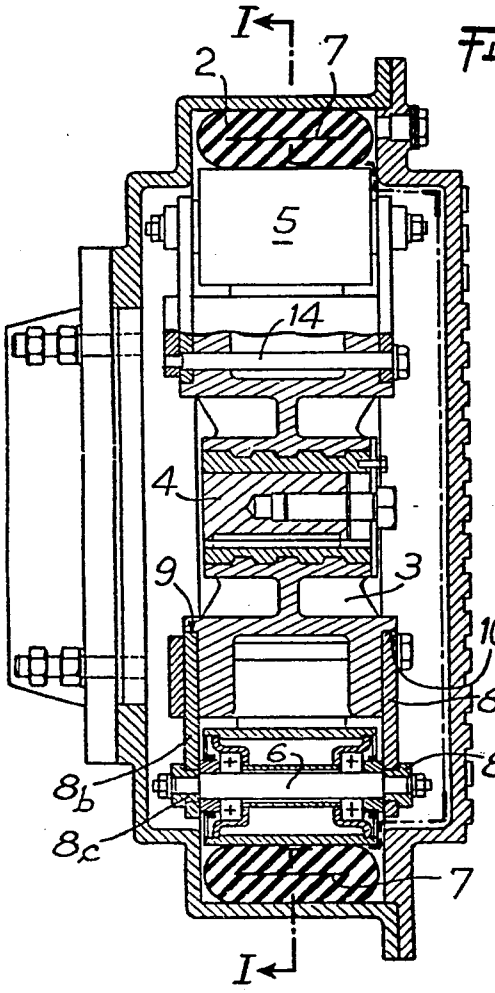

With reference to FIGS. 1 and 2, we recall hereafter the constitution of a peristaltic pump. In a stator 1 which comprises a fixed surface 1*a* (semi-cylindrical in this case) is placed an elastically deformable tube 2, clamped by its ends to the stator 1 and placed along the surface 1*a*. A rotor 3 rotates inside the stator 1 about an axle 4 situated on the axis of the cylindrical surface 1*a*. This rotor comprises two crushing members 5 (in the illustrated example, rollers mounted for rotating on the rotor about axles 6) which members are diametrically opposite and flatten the tube 2 against the surface 1*a* by creating a sealed zone 7 which divides the inner volume of the tube into two chambers, a delivery chamber upstream and a suction chamber downstream. It will be noted that other types of pump can work on the same principle and comprise a plurality of tube-crushing rollers. In this case, the rollers are regularly distributed around the rotor and the surface 1*a* is limited to a portion of cylinder, the center angle of which is equal to the angular offset of two successive rollers.

For the pump to work well, one of the important parameters to determine is the quality of the tube-crushing which is conditioned by the distance D separating the stress-bearing generating line of the roller 5 of the supporting face 1*a*. This distance should be adjustable in order to obtain an optimum crushing effect which will ensure a good tightness for the said zone 7 without really overcrushing the tube (which would give rise to fatigue and excessive wearing down of the tube). This adjustment is essentially dependent on the nature of the tube, of the product to be transported and of the conditions in which the pump is used.

It is also necessary, after initial adjustment of the value of distance D, to be able to alter it to allow for the variations of the mechanical characteristics of the tube and of its wear as time goes by.

To this effect, a device is provided for adjusting the radial position of the rollers 5 with respect to the axle 4 of the rotor 3. In FIGS. 1, 2, 3 and 3A, this device consists in a support 8 for the axle 6 of the rollers, which support is removably fixed to the rotor 3. Said support is constituted by two side members 8*a* and 8*b*, equipped at one of their ends with a bearing 8*c* for the axle 6 and which comprise, perpendicularly to the axle of said bearing, a reference surface 9. The rotor 3 is also provided with a reference surface 10 which is perpendicular to its rotation axle 4 to receive the surface 9. Moreover, the support 8 and the rotor 3 have corresponding indexing means 11 to mark the position of the support on the rotor which means are constituted by at least one orifice 12 provided in each of the said side members 8*a* and 8*b* and a plurality of orifices 13 provided in the rotor. When orifice 12 is placed over one of the orifices 13, a tightening pin 14 can be fitted in to fix the support to the rotor. It is also possible for the plurality of orifices 13 to be provided on the support and for the orifice 12 to be provided on the rotor. Moreover, and as illustrated in the figures, the support 8 comprises a plurality of orifices 12*a*, 12*b*, 12*c* (to be more precise, a double plurality to allow the aforesaid fixation by two pins 14) each orifice having its corresponding orifice in the plurality of orifices 13*a*, 13*b*, 13*c* of the rotor.

FIG. 3 shows that by placing orifices 12*a* over orifices 13*a*, a position 8' of the support is obtained. The positions 8'' and 8''' are obtained respectively by placing orifice 12*b* over orifice 13*b* and orifice 12*c* over 13*c*. The cooperation of the reference faces 9 and 10, remaining in contact, guide the passage from one to the other positions. It is thus clear that if position 8' defines a distance A separating the bearing 6 of the roller from the rotation axle 4 of the rotor 3 (which distance can be minimum), the positions 8'' and 8''' define distances B and C which are by construction different one from the other and from the distance A, and larger than A if the latter is minimum (meaning if the straight line joining the axle 4 to the bearing 6 in its position 8' is perpendicular to the surface 10). This being a means to regulate the radial distance separating the rollers from the rotor axle and therefore a means to regulate the said distance D.

For the rollers to keep the same angular offset (in this case 180°), the dispositions to regulate the support 8 of the other roller will be symmetrical to those described with respect to the axle of the rotor 4.

The invention is in no way limited to the description given hereinabove, but on the contrary covers any variant that can be brought thereto without departing from its scope or its spirit.

What is claimed is:

1. A peristaltic pump comprising a stator, an elastically deformable tube placed along a supporting surface of the stator and a rotor provided with a plurality of evenly distributed members designed to crush the tube against said supporting surface, each of said crushing members being coupled to the rotor by way of an element for adjusting the radial distance between said crushing member and the axis of rotation of the rotor, whereas said element for adjusting each crushing member is a support for a pivoting axle of said member, which support is provided with a reference surface held in contact with a reference surface of the rotor, parallel to the rotation axis of the rotor and substantially perpendicular to the radius joining the pivoting axle of the crushing member to said rotation axis, and whereas at least a first plurality of orifices is provided in the rotor and at least a second plurality of orifices, differently positioned, is provided in said support, selected ones of the orifices of the first plurality being optionally disposed over a selected one of the orifices of the second plurality of orifices by moving the support with respect to the rotor along said reference surfaces, the two coinciding orifices receiving a connecting member which traverses them in order to secure the support on the rotor in the selected position of adjustment.

2. A peristaltic pump as claimed in claim 1, wherein two diametrically opposite crushing members are provided, and the rotor comprises two parallel reference surfaces, each surface cooperating with a corresponding support.

* * * * *

UNITED STATES PATENT AND TRADEMARK OFFICE

CERTIFICATE OF CORRECTION

PATENT NO. : 4,484,864

DATED : November 27, 1984

INVENTOR(S) : Raymond Michel

It is certified that error appears in the above-identified patent and that said Letters Patent is hereby corrected as shown below:

The Title Page should be deleted to appear as per attached title page.

Signed and Sealed this

*Seventh* Day of *May 1985*

[SEAL]

*Attest:*

DONALD J. QUIGG

*Attesting Officer*

*Acting Commissioner of Patents and Trademarks*

United States Patent [19]

Michel

[11] Patent Number: 4,484,864

[45] Date of Patent: Nov. 27, 1984

[54] PERISTALTIC PUMP

[75] Inventor: Raymond Michel, Juvisy sur Orge, France

[73] Assignee: Delasco, Paris, France

[21] Appl. No.: 452,334

[22] Filed: Dec. 22, 1982

[30] Foreign Application Priority Data

Dec. 31, 1981 [FR] France ..... 81 24613

[51] Int. Cl.[3] ..... F04B 43/12; F04B 45/08

[52] U.S. Cl. ..... 417/477

[58] Field of Search ..... 417/475, 476, 477

[56] References Cited

U.S. PATENT DOCUMENTS

| | | | |
|---|---|---|---|
| 459,055 | 9/1891 | Truax | 417/477 |
| 3,431,864 | 3/1969 | Jones | 417/475 |
| 3,700,361 | 10/1972 | De Vries | 417/477 |
| 3,762,836 | 10/1973 | De Vries | 417/477 X |
| 4,095,923 | 6/1978 | Cullis | 417/477 X |

FOREIGN PATENT DOCUMENTS

| | | | |
|---|---|---|---|
| 1402241 | 5/1965 | France . | |
| 2288238 | 5/1976 | France . | |
| 681 | of 1902 | United Kingdom | 417/477 |
| 245057 | 1/1926 | United Kingdom . | |
| 628785 | 9/1949 | United Kingdom | 417/477 |
| 1167570 | 10/1969 | United Kingdom . | |
| 1498376 | 1/1978 | United Kingdom . | |
| 1506697 | 4/1978 | United Kingdom . | |

*Primary Examiner*—Richard E. Gluck

*Attorney, Agent, or Firm*—Dennison, Meserole, Pollack & Scheiner

[57] ABSTRACT

The invention relates to the means provided in a peristaltic pump to regulate the radial distance between a crushing roller and the axle of rotation of the rotor.

The rotor comprises at least one reference face parallel to its axle of rotation, the regulating element being a support of the axle of rotation of the roller provided with a surface which is held in contact with the face of the rotor, whereas a plurality of orifices are provided in the rotor and one orifice is provided in the support and is designed to be placed over one of the orifices of said plurality by moving the support along the said face and surface and to receive a connecting member traversing them.

The invention finds an application in peristaltic pumps.

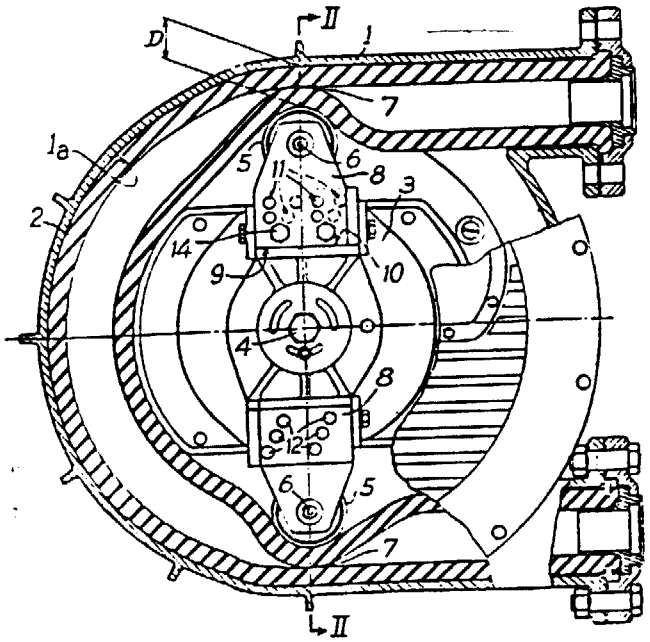

2 Claims, 4 Drawing Figures